United States Patent [19]

Ward et al.

[11] Patent Number: 4,600,497

[45] Date of Patent: Jul. 15, 1986

[54] PROCESS FOR TREATING WAXY SHALE OILS

[75] Inventors: John W. Ward, Yorba Linda; Timothy L. Carlson, Placentia, both of Calif.

[73] Assignee: Union Oil Company of California, Los Angeles, Calif.

[21] Appl. No.: 262,031

[22] Filed: May 8, 1981

[51] Int. Cl.[4] ..... C10G 45/64; C10G 65/12

[52] U.S. Cl. ..... 208/89; 208/111; 208/254 H; 208/216 R

[58] Field of Search ..... 208/89, 57, 111, 254 R, 208/254 H, 216 R

[56] References Cited

U.S. PATENT DOCUMENTS

| | | | |
|---|---|---|---|
| 2,789,083 | 4/1957 | Hardy | 208/251 R |
| 3,140,322 | 7/1964 | Frilette et al. | 208/120 |
| 3,487,005 | 12/1969 | Egan et al. | 208/59 |
| 3,506,568 | 4/1970 | Annesser et al. | 208/89 |
| 3,516,925 | 6/1970 | Lawrence et al. | 208/111 |
| 3,700,585 | 10/1972 | Chen et al. | 208/111 |
| 3,702,886 | 11/1972 | Argauer et al. | 423/328 |
| 3,738,931 | 6/1973 | Frankovich et al. | 208/67 |
| 3,755,138 | 8/1973 | Chen et al. | 208/33 |
| 3,755,145 | 8/1973 | Orkin | 208/111 |
| 3,761,395 | 9/1973 | Child et al. | 208/89 |
| 3,804,750 | 4/1974 | Myers et al. | 208/253 |
| 3,852,189 | 12/1974 | Chen et al. | 208/120 |
| 3,891,540 | 6/1975 | Demmel et al. | 208/77 |
| 3,894,938 | 7/1975 | Gorring et al. | 208/97 |
| 3,894,939 | 7/1975 | Garwood et al. | 208/111 |
| 3,926,782 | 12/1975 | Plank et al. | 208/135 |
| 3,956,102 | 5/1976 | Chen et al. | 208/93 |
| 3,968,024 | 7/1976 | Gorring et al. | 208/111 |
| 3,980,550 | 9/1976 | Gorring et al. | 208/111 |
| 4,022,682 | 5/1977 | Bludis et al. | 208/89 |
| 4,054,510 | 10/1977 | Parker | 208/120 |
| 4,067,797 | 1/1978 | Chen et al. | 208/15 |
| 4,137,148 | 1/1979 | Gillespie et al. | 208/87 |
| 4,149,960 | 4/1979 | Garwood et al. | 208/111 |
| 4,153,540 | 5/1979 | Gorring et al. | 208/89 |
| 4,159,241 | 6/1979 | Simo | 208/251 H |
| 4,176,050 | 11/1979 | Chen et al. | 208/111 |
| 4,181,598 | 1/1980 | Gillespie et al. | 208/58 |
| 4,188,280 | 2/1980 | Jensen | 208/53 |
| 4,213,847 | 7/1980 | Chen et al. | 208/111 |
| 4,229,282 | 10/1980 | Peters et al. | 208/111 |
| 4,238,320 | 12/1980 | Cronauer et al. | 208/254 H |
| 4,263,129 | 4/1981 | Chen et al. | 208/111 |
| 4,284,529 | 8/1981 | Shihabi | 208/111 |
| 4,342,641 | 8/1982 | Reif et al. | 208/89 |
| 4,344,840 | 8/1982 | Kunesh | 208/59 |
| 4,356,079 | 10/1982 | Desaau | 208/10 |
| 4,358,362 | 11/1982 | Smith et al. | 208/91 |
| 4,358,363 | 11/1982 | Smith | 208/91 |
| 4,359,378 | 11/1982 | Scott | 208/120 |
| 4,361,477 | 11/1982 | Miller | 208/67 |
| 4,406,779 | 9/1983 | Hensley, Jr. et al. | 208/254 H |
| 4,419,218 | 12/1983 | Angevine et al. | 208/59 |
| 4,431,518 | 2/1984 | Angevine et al. | 208/111 |
| 4,434,047 | 2/1984 | Hensley, Jr. et al. | 208/111 |
| 4,462,897 | 7/1984 | Miller | 208/254 H |
| 4,476,011 | 10/1984 | Tait et al. | 208/111 |
| 4,501,652 | 2/1985 | Le et al. | 208/57 |
| 4,508,615 | 4/1985 | Oleck et al. | 208/89 |
| 4,519,900 | 5/1985 | Angevine et al. | 208/254 H |

OTHER PUBLICATIONS

Lander, H. R., "Jet Fuel Looks to Shale Oil: 1980 Technology Review," Proc. Symposium 19-20 Nov. 1980, AFWAL-TR-81-2063, pp. 135-151.

"Chemical and Physical Properties of the ZSM-5 Substitutional Series", by Olson et al., in *Journal of Catalysis,* vol. 61, pp. 390 to 396 (1980).

"Cat. Dewaxing Process Improved", Donnelly et al., Oil & Gas Journal 77-82 (Oct. 27, 1980).

*Primary Examiner*—Andrew H. Metz

*Assistant Examiner*—O. Chaudhuri

*Attorney, Agent, or Firm*—Gregory F. Wirzbicki; Dean Sandford

[57] ABSTRACT

Waxy shale oil feeds containing organonitrogen and/or organosulfur components are contacted with a catalyst comprising a Group VIB metal component on a support containing a crystalline aluminosilicate zeolite of the ZSM-5 type and a porous refractory oxide under conditions of elevated temperature and pressure and in the presence of hydrogen so as to simultaneously reduce its pour point and its organosulfur and/or organonitrogen content.

67 Claims, No Drawings

PROCESS FOR TREATING WAXY SHALE OILS

BACKGROUND OF THE INVENTION

This invention relates to the catalytic treatment of hydrocarbons in the presence of hydrogen and under conditions of elevated temperature and pressure. More particularly, it relates to treating waxy paraffinic hydrocarbons, particularly full boiling range shale oils, so as to simultaneously lower the pour point thereof by catalytic hydrodewaxing and lower the organosulfur and/or organonitrogen contents thereof by catalytic hydrotreating.

Many hydrocarbon liquid feedstocks have the undesirable properties of high pour point, which causes pumping difficulties under low temperature conditions, and high organonitrogen and/or organosulfur contents, which are undesirable from the standpoint that such components deactivate certain refining catalysts or, if present in the ultimate product when combusted, contribute to atmospheric pollution. One such feedstock is raw shale oil, a feedstock obtained by retorting oil shale, such as the oil shale found in the Colorado River formation in the western United States. When retorted under temperature conditions above about 900° F., a material in the oil shale known as kerogen decomposes, releasing shale oil vapors, which are condensed and collected by known techniques to produce raw liquid shale oil. Such raw shale oil is undesirable because it usually contains solid particulates, arsenic, and organonitrogen and/or organosulfur components. In addition, the raw shale oil has a high pour point, usually in the range of 50° to 90° F., indicative of the presence of a relatively high proportion of wax components, i.e., straight chain and slightly branched paraffins of high molecular weight.

Raw shale oil may be treated by known techniques to reduce the ash and arsenic contents thereof, and it is now known by the teachings in U.S. Pat. No. 4,153,540 issued to Gorring et al. that shale oil can be upgraded by a two-step method in which the shale oil is first contacted with a hydrotreating catalyst under conditions such that the organosulfur and organonitrogen contents of the shale oil are reduced. Subsequently, the hydrotreated shale oil is contacted with a hydrodewaxing catalyst under conditions (750° to 1000° F., 500 to 1500 psig, 0.25 to 1.0 LHSV, and a hydrogen feed rate of 5 to 6 moles per mole of feedstock) such that the feedstock is hydrodewaxed while its 750° F.+ fraction is converted by at least 50% to products boiling below 750° F. The hydrodewaxing catalyst employed by Gorring et al. is similar to that of Chen et al. described in U.S. Pat. No. Re.28,398, that is, it comprises a ZSM-5 zeolite in its hydrogen form combined with a metal having activity for promoting hydrogenation/dehydrogenation reactions.

Although the two-step process described in U.S. Pat. No. 4,153,540 results in a significant reduction in the pour point of the shale oil, it also results in a shale oil product that contains undesirable proportions of organosulfur and organonitrogen components. In particular, the shale oil products reported in the Examples of U.S. Pat. No. 4,153,540 contain excessively high proportions of total nitrogen. One product, for example, contained 1.10 wt.% total nitrogen, representing only about a 50% reduction in organonitrogen components after two hydroprocessing steps. By most refining standards, such a shale oil product would require yet more hydrotreating to reduce the nitrogen content still further, for example, to below about 250 wppm.

In addition, the hydrodewaxing catalyst described in U.S. Pat. No. 4,153,540 exhibits an undesirable amount of hydrocracking. Ideally, one would want to treat the shale oil so as to substantially reduce its organosulfur and organonitrogen contents and its pour point without also (as would be the case in severe hydrocracking) substantially altering the boiling characteristics of the shale oil. But in the process described in U.S. Pat. No. 4,153,540, it appears that the hydrocracking is indiscriminate, that is, the waxy paraffins are hydrocracked sufficiently to lower the pour point but not without also cracking 50% or more of the 750° F.+ components as well. Such excessive hydrocracking is especially undesirable if the shale oil is treated for pour point reduction at a distance remote from an oil refinery; it forces one to employ extensive recovery facilities for handling light end materials such as propane and butane and for generating hydrogen in a location where such is usually impractical. Additionally, and perhaps more importantly, to hydrocrack a shale oil so as to convert 50% or more of the 750° F.+ fraction while only about 50% of the nitrogen is removed is an inefficient use of hydrogen, particularly when severe hydrocracking is not desired but low nitrogen-containing shale oil products are.

Accordingly, it is one of the objects of the present invention to provide a process for substantially reducing the pour point, sulfur content, and nitrogen content of shale oil feedstocks and other waxy hydrocarbon feedstocks while minimizing the amount of hydrogen consumed. It is another object to provide such a process having the further advantage of selectively hydrocracking the waxy paraffins while not substantially hydrocracking other components. It is yet another object to provide a process wherein a shale oil feedstock containing more than about 0.2 wt.% organosulfur components, and more than about 1.50 wt.% organonitrogen components, and having a pour point above about 50° F. is converted, without substantially disturbing the boiling characteristics of the shale oil, to a shale oil product having a pour point below about 30° F. and containing less than about 400 wppm organonitrogen compounds and less than 25 wppm organosulfur compounds. It is yet another object to provide a catalyst having high activity for selectively hydrocracking a waxy, sulfur-containing and nitrogen-containing hydrocarbon feedstock such that a substantial reduction in the wax content thereof, as evidenced by a substantial reduction in pour point, is obtained simultaneously with a substantial reduction in the organosulfur and organonitrogen compounds contents. These and other advantages will become more apparent in view of the following description of the invention.

SUMMARY OF THE INVENTION

It has been discovered in the present invention that waxy hydrocarbon feedstocks, particularly those derived from synthetic shale oil, having relatively high pour points and containing organosulfur and/or organonitrogen compounds may be simultaneously hydrodewaxed and hydrotreated by contact under conditions of elevated temperature and pressure and the presence of hydrogen with a hydroprocessing catalyst comprising a Group VIB metal component on a support comprising an intimate admixture of a porous refractory oxide and a crystalline aluminosilicate zeolite of the ZSM-5 type. In comparison to the feedstock, the product hydrocarbon is substantially reduced in pour point, organonitrogen components, and organosulfur components.

It has also been discovered that the catalyst used in the invention is most especially useful for simultaneously hydrotreating and hydrodewaxing a waxy, full boiling range shale oil that has previously been deashed, dearsenated, and hydrotreated but still contains unacceptable proportions of organosulfur and/or organonitrogen components and has an unacceptably high pour point. One of the advantages of the catalyst used in the invention is that, even under relatively severe hydroprocessing conditions, as for example, 2000 psig and 750° F., the waxy components and organosulfur and organonitrogen components are removed without substantially altering the boiling characteristics of the feedstock being treated, particularly with respect to the heavy fractions thereof.

For purposes herein, all references to proportions of organosulfur or organonitrogen components, calculated as sulfur or nitrogen, respectively, refers to the weight proportion of total sulfur or nitrogen in the liquid hydrocarbon under consideration. Thus, for example, a liquid hydrocarbon weighing 100 grams and containing 40 grams of organonitrogen components, only 1 gram of which is due to nitrogen atoms, contains 1 weight percent of organonitrogen components calculated as nitrogen. There are standard tests known in the petroleum industry for determining the proportions of total nitrogen and total sulfur in a liquid hydrocarbon, such as the Kjeldahl test for nitrogen.

DETAILED DESCRIPTION OF THE INVENTION

The process of the present invention is directed to lowering the pour point and the organonitrogen and/or organosulfur content of a waxy hydrocarbon feedstock by contact with a catalyst under conditions of elevated temperature and pressure in the presence of hydrogen. Typical feedstocks for treatment herein have a pour point above 50° F., an organonitrogen content (calculated as nitrogen) above about 500 wppm, and an organosulfur content (calculated as sulfur) above about 25 wppm. The preferred feedstock is a full range shale oil or a fraction thereof, and the most preferred feedstock is a full range shale oil that has been successively deashed, as by filtration or electrostatic agglomeration, dearsenated, as by the process described in U.S. Pat. No. 4,046,674, herein incorporated by reference in its entirety, and catalytically hydrotreated, as by contact with a hydrotreating catalyst comprising Group VIB and Group VIII metal components on a porous refractory oxide support. When such a sequential deashing-dearsenating-hydrotreating method is applied to shale oils derived by retorting oil shale found in the Colorado River formation and adjacent areas, the full boiling range shale oil will typically have a boiling point range between about 80° F. and about 1030° F., an organonitrogen content between about 200 and 3500 wppm, usually between about 300 and 2000 wppm, an organosulfur content between about 30 and 2000 wppm, usually between about 35 and 100 wppm, and a pour point above about 70° F., usually between about 75° and 90° F.

For a typical raw shale oil derived from retorting Colorado oil shale, the sequential treatment specified in the preceding paragraph will generally alter the chemical and pour point characteristics of the oil as shown in Table I, with it being specifically noted that the dearsenating step, wherein a sulfided nickel and molybdenum-containing catalyst, usually containing between about 30 and 70 wt.% nickel components, calculated as NiO, and between 2 and 20 wt.% molybdenum components, calculated as $MoO_3$, on a porous refractory oxide support, such as alumina, is effective for lowering the sulfur and nitrogen contents as well as the arsenic content of the deashed shale oil.

TABLE I

| | Typical Raw Shale Oil | Deashed Shale Oil | Dearsenated Shale Oil | Hydrotreated Shale Oil |
|---|---|---|---|---|
| Pour Point, °F. | 50–65 | 50–65 | 50–70 | 65–90 |
| Sulfur, wt. % as S | 0.5–1.5 | 0.5–1.5 | 0.2–1.0 | 0.003–0.2 |
| Nitrogen, wt. % as N | 1.6–2.2 | 1.6–2.2 | 1.4–2.0 | 0.020–0.350 |
| Arsenic, wppm as As | 40–70 | 20–30 | <1 | <1 |

In accordance with the invention, the shale oil or other waxy hydrocarbon feedstock is contacted with a particulate catalyst described more fully hereinafter. Usually the contacting will be accomplished in a suitable reactor vessel under conditions of elevated temperature and pressure, with pressures above about 750 psig, usually above 1000 psig being suitable, and between about 1500 and 3000 psig being preferred, and with temperatures above about 650° F. being suitable and temperatures between about 650° and 800° F. being most suitable, primarily because temperatures above about 800° F. usually exceed the metallurgical temperature constraints of commercial, high pressure steel reactors. The rate at which the feedstock is passed through the reactor in contact with the catalyst particles is usually at a liquid hourly space velocity between about 0.1 and 10.0, but preferably between about 0.5 and 2.0. Hydrogen is also required and is usually passed through the reactor at a rate above about 500 standard cubic feet per barrel of feedstock, preferably between about 1500 and 15,000 standard cubic feet per barrel.

Under conditions selected from the foregoing, and with the ZSM-5-containing catalyst to be described hereafter, substantial reductions in pour point, organonitrogen content, and organosulfur content are obtainable. In general, reductions in organonitrogen contents over 75% complete and organosulfur contents over 50% complete are obtainable, while substantial reductions in the pour point are simultaneously achieved.

Catalysts useful in the present invention are composed of one or more Group VIB active metal components, particularly the Group VIB metals, oxides, and sulfides, on a support comprising an intimate admixture of a porous refractory oxide and a crystalline aluminosilicate zeolite of the ZSM-5 type, preferably in an acidic form. The preferred catalyst contains, in addition to Group VIB metal components, one or more Group VIII metal components, particularly the metals, oxides, and sulfides of the iron Group VIII elements, i.e., iron, cobalt, and nickel. Especially contemplated are catalysts containing a nickel and/or cobalt component in combination with a tungsten and/or molybdenum component. The most highly preferred catalyst comprises both nickel and tungsten components, especially in the sulfide form. The proportion by weight of the catalyst that comprises the Group VIB metal components is between about 5 and 40%, preferably between about 15 and 30%, calculated as the metal trioxide. The proportion by weight of the catalyst that comprises the Group VIII metal components is between about 0.5 and 15%, preferably between about 1 and 5%, calculated as the metal monoxide.

The porous refractory oxides useful as supports in the hydrotreating-hydrodewaxing catalyst herein include the oxides of difficultly reducible metals, particularly those containing aluminum. Representative of such refractory oxides are alumina, silica, beryllia, chromia, zirconia, titania, magnesia, and thoria. Also representative are silica-alumina, silica-titania, silica-zirconia, silica-zirconia-titania, zirconia-titania, and other such combinations. A specific refractory oxide known to be useful consists essentially of a dispersion of finely divided silica-alumina in a matrix of alumina; this material is more fully described in U.S. Pat. No. 4,097,365, herein incorporated by reference in its entirety. The preferred refractory oxide, however, is alumina, most preferably, gamma alumina, and as with all the refractory oxides contemplated herein, the preferred gamma alumina has a surface area above about 100 $m^2/gm$.

Also included in the support, usually as a dispersion in the porous refractory oxide, is a crystalline aluminosilicate zeolite of the ZSM-5 type, such as ZSM-5, ZSM-11, ZSM-12, ZSM-23, ZSM-35, ZSM-38, and the like, with ZSM-5 being preferred. ZSM-5 is a known zeolite and is more fully described in U.S. Pat. No. 3,702,886 herein incorporated by reference in its entirety; ZSM-11 is a known zeolite and is more fully described in U.S. Pat. No. 3,709,979, herein incorporated by reference in its entirety; ZSM-12 is a known zeolite and is more fully described in U.S. Pat. No. 3,832,449, herein incorporated by reference in its entirety; ZSM-23 is a known zeolite and is more fully described in U.S. Pat. No. 4,076,842, herein incorporated by reference in its entirety; ZSM-35 is a known zeolite and is more fully described in U.S. Pat. No. 4,016,245, herein incorporated by reference in its entirety; and ZSM-38 is a known zeolite and is more fully described in U.S. Pat. No. 4,046,859, herein incorporated by reference in its entirety. These zeolites are known to readily adsorb benzene and normal paraffins, such as n-hexane, and also certain mono-branched paraffins, such as isopentane, but to have difficulty adsorbing di-branched paraffins, such as 2,2-dimethylbutane, and polyalkylaromatics, such as meta-xylene. These zeolites are also known to have a crystal density not less than 1.6 grams per cubic centimeter, a silica-to-alumina ratio of at least 12, and a constraint index, as defined in U.S. Pat. No. 4,229,282, incorporated by reference herein in its entirety, within the range of 1 to 12. The foregoing zeolites are also known to have an effective pore diameter greater than 5 Angstroms and to have pores defined by 10 membered rings of oxygen atoms, as explained in U.S. Pat. No. 4,247,388 herein incorporated by reference in its entirety. Such zeolites are preferably utilized in the acid form, as by replacing at least some of the metals contained in the ion exchange sites of the zeolite with hydrogen ions. This exchange may be accomplished directly with an acid or indirectly by ion exchange with ammonium ions followed by calcination to convert the ammonium ions to hydrogen ions. In either case, it is preferred that the exchange be such that a substantial proportion of the ion exchange sites utilized in the catalyst support be occupied with hydrogen ions.

In the preferred embodiment of the invention, the support consists essentially of an intimate admixture of the zeolite and a porous refractory oxide such as alumina. The proportion of zeolite in the support may vary in the range of 2 to 90% by weight, but preferably the support consists essentially of a heterogeneous dispersion of zeolite in a matrix of alumina or other porous refractory oxide. Such a dispersion contains the zeolite in a minor proportion, usually between about 15 and 45%, and more usually between 20 and 40%, by weight, with 30% being most highly preferred.

The catalyst used in the invention is most preferably prepared in particulate form, with the clover-leaf particulate form shown in FIGS. 8 and 8A of U.S. Pat. No. 4,028,227 being most highly preferred. One convenient method for preparing the catalyst involves first comulling a wetted mixture of zeolite, an alumina gel, and an alumina binder material, such as Catapal® peptized alumina, in proportions appropriate to what is desired in the final catalyst support. Such a comulled mixture is then extruded through a die having suitable small openings therein in the shape of circles or ellipses, or as is preferred, in the shape of three-leaf clovers. The extruded material is cut into small particulates, dried, and calcined, following which the resulting support particles are impregnated with a liquid solution containing the desired Group VIB element in dissolved form, with other active components, such as nickel, or even an acidic component, such as phosphorus, known for its property to promote hydrotreating reactions, being optionally included. A specifically contemplated impregnation liquid consists essentially of an aqueous solution of dissolved ammonium metatungstate and nickel nitrate, with the dissolved components being present in the impregnation liquid in proportions sufficient to insure that the final catalyst contains more than about 15% by weight tungsten components calculated as $WO_3$ and more than about 0.5% by weight nickel components calculated as NiO. If desired, phosphorus components may also be present in the impregnation liquid so that the final catalyst contains, for example, more than about 0.5% by weight phosphorus components calculated as P. After impregnation, the impregnated composite particles are calcined in air at temperatures at or above about 900° F. for a time period sufficient to convert the metal components to oxide forms.

In an alternative method, the foregoing procedure is altered such that, instead of introducing the Group VIB and/or Group VIII metal components into the support by impregnation, they are incorporated into the catalyst by admixing an appropriate solid or liquid containing the desired metal with the materials to be extruded through the die. Such a method may prove less expensive and more convenient on a commercial scale than the impregnation method.

Other known methods for depositing the Group VIB and VIII metals on the support may be utilized to produce the catalyst of the invention. It is specifically noted, however, as to the Group VIII metal, that although the Group VIII metal may undergo some ion exchange with the cations in the zeolite during preparation of the catalyst, it is preferred that at least some Group VIII metal be deposited on the support in locations other than the ion exchange sites of the zeolite component. To insure this result, the catalyst is preferably prepared to contain more than that amount of Group VIII metal that would fully occupy the ion exchange sites of the zeolite component in the catalyst.

It is most highly preferred in the invention that the catalyst be converted to the sulfide form, that is, to a form wherein the metal components are converted in substantial part to sulfides. This may be accomplished by contacting the catalyst with a gas stream consisting of hydrogen and 10 volume percent hydrogen sulfide at an elevated temperature. Alternatively, if the waxy feedstock with which it is to be contacted contains organosulfur components, the catalyst may be merely placed into service in the oxide form, and under the conditions hereinbefore specified for simultaneously hydrodewaxing and hydrotreating such feedstocks, the catalyst is readily converted to the sulfide form in situ.

The foregoing catalyst has been found to have excellent catalytic properties for promoting hydrotreating reactions and for selectively hydrocracking a waxy hydrocarbon so as to simultaneously lower its sulfur and/or nitrogen content and lower its pour point and viscosity without otherwise substantially altering its chemical and physical properties. Especially noteworthy is the fact that the waxy feedstock may be simultaneously hydrotreated and hydrodewaxed without an undue change in the boiling point characteristics of the hydrocarbon being treated. There must, of course, be some change in boiling characteristics because hydrodewaxing is a form of hydrocracking, and hydrocracking of necessity produces hydrocarbons of lowered boiling points. But the catalyst used in the invention is highly selective for hydrocracking waxy paraffins, and such is evidenced in the invention by the sharp drop in pour point and the relatively small amount of conversion of high boiling feed components into lower boiling products. Usually, no more than about 15 to 25% by volume of the high boiling components, and particularly the components boiling above about 670° F., are converted to lower boiling products. Such small percentage conversions of high boiling components are indicative of efficient hydrogen utilization, for the less hydrogen consumed in unnecessarily hydrocracking non-waxy components or unnecessarily converting components other than the organosulfur and/or organonitrogen components, the less costly will be the hydrogenating facilities required to carry out the process of the invention.

Another advantageous feature of the catalyst used in the invention is its stability, that is, its long life for the intended simultaneous hydrodewaxing and hydrotreating reactions required to convert waxy shale oils and the like into more valuable products. No significant deactivation of the preferred catalyst has been detected when utilized under preferred conditions for a time period of twenty-eight days.

The following Example is provided to illustrate the process of the invention and to provide evidence of the superior properties of the catalyst used in the invention. This Example, as well as the second Example hereinafter presented, is not provided to limit the scope of the invention, which is defined by the claims.

EXAMPLE I

A deashed-dearsenated-hydrotreated shale oil, designated F-3420, had the properties and characteristics shown in Table II. This feedstock was obtained by electrostatically deashing a raw, full range shale oil derived from retorting Colorado oil shale, dearsenating the resulting deashed shale oil by a method described in U.S. Pat. No. 4,046,674 such that the resultant product was not only virtually free of arsenic but contained 1.8 wt.% nitrogen and 0.835 wt.% sulfur and had a pour point of 55° F. This deashed-dearsenated product was then hydrotreated under conditions of elevated temperature and pressure in the presence of added hydrogen and a sulfided catalyst comprising about 18 wt.% molybdenum components, calculated as $MoO_3$, about 3 wt.% nickel components, calculated as NiO, and about 3 wt.% phosphorus components, calculated as P, on a gamma alumina support having a three-leaf clover cross-sectional shape.

TABLE II

| | | ASTM Distillation, D-1160 | |
|---|---|---|---|
| Gravity, °API | 35.0 | | |
| Pour Point | +80 | Initial BP | 223° F. |
| Kinematic Viscosity | | 10% | 394° F. |
| at 100° F., cSt | 6.50 | 50% | 660° F. |
| at 100° F., SUS | 47.2 | 90% | 914° F. |
| Nitrogen, wppm | 900 | EP | 1027° F. |
| Sulfur, wppm | 41 | | |

The foregoing feedstock was passed through a reactor containing a bed of catalyst particles under the following conditions: 2000 psig, 1.0 LHSV, 8000 scf/bbl once-through $H_2$-to-oil ratio, 266 lbs/hr-ft$^2$ mass velocity, and temperatures between about 730° and 750° F. The catalyst particles had a surface area of 251 m$^2$/gm and a compacted bulk density of 0.92 gm/ml and were composed of 2.6 wt.% nickel components, calculated as NiO, and 20.3 wt.% tungsten components, calculated as $WO_3$, on a support consisting essentially of 70% alumina (including binder material) and 30% of a crystalline alumino-silicate zeolite in the hydrogen form, said zeolite having an X-ray diffraction pattern similar to ZSM-5 as shown in Table 1 of U.S. Pat. No. 3,702,886, said zeolite further containing 3.7% alumina, as $Al_2O_3$, and having a silica-to-alumina ratio of about 43.

To simulate the entire effluent that would be obtained from the hydrotreater from which the shale oil above described was recovered, thiophene and tertiary butylamine were fed into the reactor. The thiophene was fed at a rate sufficient to simulate the amount of $H_2S$ produced from hydrotreating a feedstock containing 0.84 wt.% sulfur, and the tertiary butylamine was fed at a rate sufficient to simulate the amount of ammonia that would be produced from the same hydrotreating feedstock also containing 1.8 wt.% organonitrogen components, calculated as nitrogen.

A summary of the results as to pour point, sulfur, and nitrogen of the product obtained from the foregoing experiment is as follows:

TABLE III

| Average Bed Temperature in Reactor, °F. | Nitrogen, wppm | Sulfur, wppm | Pour Point |
|---|---|---|---|
| 735 | 231 | N.D.* | +55° F. |
| 740 | 219 | N.D.* | +50° F. |
| 745 | 196 | 5 | +35° F. |
| 750 | 163 | 7 | +20° F. |

*Not Determined

A comparison of simulated distillation data of a product having a +30° F. pour point versus that of the feedstock is as follows:

TABLE IV

| Volume % | Feedstock | Product |
|---|---|---|
| 1 | 215° F. | 200° F. |
| 5 | 300° F. | 285° F. |
| 10 | 350° F. | 335° F. |
| 20 | 430° F. | 408° F. |
| 30 | 500° F. | 470° F. |
| 40 | 560° F. | 518° F. |
| 50 | 625° F. | 587° F. |

TABLE IV-continued

| Volume % | Feedstock | Product |
|---|---|---|
| 60 | 691° F. | 647° F. |
| 70 | 755° F. | 715° F. |
| 80 | 825° F. | 785° F. |
| 90 | 905° F. | 870° F. |
| 95 | 960° F. | 930° F. |
| Max. | 1000° F. @ 97.5 vol. % | 1000° F. @ 98.0 vol. % |

As shown by the foregoing data, the treatment of the hydrotreated shale oil by the method of the invention does not substantially alter the shale oil boiling point characteristics. Moreover, it is contemplated that at least three fractions of the product obtained by treating hydrotreated shale oil in a manner similar to that described in this Example have improved freeze point, cloud point, and pour point characteristics in comparison to the hydrotreated feedstock. The three specific fractions so contemplated are the diesel fraction having a true boiling point range (as opposed to an ASTM distillation range) of 300° to 670° F., the Jet A turbine fuel fraction having a true boiling point range of 300° to 520° F., and the JP-4 turbine fuel fraction consisting of components boiling at or below 470° F. The diesel fraction obtained in the process of the invention is contemplated to have a pour point no greater than +5° F., the Jet A fraction a freeze point no greater than −40° F., and the JP-4 fraction a freeze point no greater than −72° F. Accordingly, it is a specific embodiment of the invention to subject an essentially full boiling range shale oil of high pour point, and particularly a shale oil derived from an oil shale of the Colorado River formation, to catalytic hydrotreating followed by catalytic hydrodewaxing under conditions such that a product is obtained containing one or more of a diesel fraction, a Jet A fraction, and a JP-4 fraction meeting the pour point and/or freeze point specifications set forth above. These fractions may then be recovered from the hydrodewaxed product by conventional distillation methods.

It will be understood herein that, although in one embodiment of the invention it is an object to produce a pipelineable shale oil by reducing the pour point thereof to below 30° F., such as to 25° F., without substantially altering the boiling characteristics, in other embodiments of the invention wherein the object is to improve the product yet further, the boiling point characteristics may be more severely affected. For example, if it is desired to increase the yield of turbine fuel or diesel fuel, then conditions of increased severity during the simultaneous hydrotreating-hydrodewaxing step would be required, resulting in a greater alteration of the boiling point characteristics then would be the case if more mild conditions were employed. In these embodiments of the invention, it can be expected that more of the 670° F.+ and the 750° F.+ fractions will be converted to lower boiling constituents, especially when the pour point after the hydrotreating-hydrodewaxing step is below 0° F., for example, at −25° F. However, even in these embodiments it is expected that less than 50% of the 670° F.+ and the 750° F.+ fractions will be converted to lower boiling constituents.

One of the peculiarities of shale oils evidenced in the data in Table I is that hydrotreating results in a substantial increase in the pour point, at least when the shale oil is a full range shale oil subjected to deashing and dearsenating without hydrotreating. This curious result is believed due to the fact that hydrotreating saturates olefins, thereby producing paraffins, which, for shale oils produced from oil shales of the Colorado River formation, tend to be highly waxy. In any event, it is a specific embodiment of the invention to treat waxy shale oil feedstocks containing organonitrogen compounds and/or organosulfur compounds by first catalytically hydrotreating the feedstock so that a substantial proportion of the organonitrogen and/or organosulfur compounds are removed but the pour point is substantially increased and then contacting the hydrotreated product with the hydrodewaxing catalyst under appropriate conditions such that yet further removal of organonitrogen compounds and/or organosulfur compounds is accomplished and, concomitant therewith, the pour point of the hydrotreated shale oil is reduced to a value substantially below that of the original feedstock. In accordance with this embodiment of the invention, a deashed-dearsenated, full boiling range shale oil feedstock having a pour point above about 50° F. and containing more than about full boiling range shale oil feedstock having a pour point above about 50° F. and containing more than about 0.20 wt.% organosulfur components and more than about 1.50 wt.% organonitrogen components, calculated as sulfur and nitrogen, respectively, are catalytically hydrotreated in the presence of a typical, sulfided hydrotreating catalyst containing a Group VIB metal (e.g., Mo, W) and a Group VIII metal (e.g., Ni, Co) on a porous refractory oxide, preferably alumina, under conditions such that the pour point rises above about 70° F. while the organonitrogen content drops to between about 200 and 3500 wppm, usually between 300 and 2000 wppm, and often between 300 and 1000 wppm, and the organosulfur content drops to between about 30 and 2000 wppm. The entire effluent obtained in the hydrotreating stage, including the unreacted hydrogen and the produced ammonia and hydrogen sulfide, is then passed to a reactor wherein the effluent is cascaded downwardly through a bed of particulate catalyst containing the ZSM-5-type zeolite. Preferably, the outlet temperature of the effluent of the hydrotreating stage is the same as, or within about 25° F. of, the inlet temperature of the feed to the second stage containing the hydrotreating-dewaxing catalyst. Conditions in the second stage are such as to produce a product shale oil having a pour point below about 30° F., preferably below 25° F., an organosulfur content below about 25 wppm, preferably below 20 wppm, and an organonitrogen content below about 400 wppm, preferably below 200 wppm. Conditions from which such results may be produced from typical deashed-dearsenated shale oil feeds with the hydrotreating and hydrodewaxing-hydrotreating catalysts described in Example I hereinbefore are as follows:

TABLE V

| Condition | Hydro-treating | Simultaneous Hydro-treating-Hydrodewaxing |
|---|---|---|
| Space Velocity, LHSV | | |
| Suitable | 0.1–2.0 | 0.1–10 |
| Preferred | 0.3–0.7 | 0.5–2.0 |
| Temperature, °F. | | |
| Suitable | >650 | >650 |
| Preferred | 700–775 | 700–780 |
| Highly Preferred | 725–745 | 720–750 |
| Pressure, psig | | |
| Suitable | >750 | >750 |
| Preferred | 1500–2500 | 1500–3000 |

TABLE V-continued

| Condition | Hydro-treating | Simultaneous Hydro-treating-Hydrodewaxing |
|---|---|---|
| Highly Preferred | 2000–2500 | 2000–2500 |
| $H_2$ Added Plus $H_2$ in Recycle Gas, scf/bbl | | |
| Suitable | >500 | >500 |
| Preferred | >2000 | 1500–15,000 |
| Highly Preferred | 4000–7000 | 6000–10,000 |

The following Example is provided to illustrate the performance of two hydrotreating catalysts for use in upgrading a deashed-dearsenated shale oil to a product suitable for further refining with the hydrotreating-hydrodewaxing catalyst exemplified in Example I.

EXAMPLE II

A full range shale oil obtained from retorting Colorado oil shale was deashed and dearsenated so as to have the following properties and characteristics:

TABLE VI

| Properties and Characteristics of Feedstock | | | |
|---|---|---|---|
| Gravity, °API @ 60° F. | 21.3 | Distillation, D-1160, °F. | |
| Pour Point, °F. | 55 | IBP/5 | 210/377 |
| Viscosity @ 100° F., SUS | 154.2 | 10/20 | 446/535 |
| Viscosity @ 140° F., SUS | 71.4 | 30/40 | 614/692 |
| Sulfur, wt. % | 0.835 | 50/60 | 760/817 |
| Nitrogen, Total, wt. % | 1.80 | 70/80 | 869/929 |
| Hydrogen, wt. % | 11.61 | 90/95 | 1000/1047 |
| Total Olefins, wt. % | 18.8 | Max/Rec. | 1081/97.6 |
| Aniline Point, °F. | 40.3 | | |
| Arsenic, wppm | 0.7 | | |
| Oxygen, wppm | 119 | | |

The two catalysts utilized to treat the feedstock of Table VI are described as follows:

CATALYST A

This catalyst was a commercially available hydrotreating catalyst containing about 18 wt.% molybdenum components, calculated as $MoO_3$, 2.9 wt.% nickel components, calculated as NiO, and 3.2 wt.% phosphorus components, calculated as P, the balance being gamma alumina. The catalyst was in the form of particles having a three-leaf clover cross-sectional shape.

CATALYST B

This catalyst, being in the form of particles having three-leaf clover cross-sectional shapes similar to Catalyst A, consisted essentially of 3.90 weight percent of nickel components, calculated as NiO, and 23.2 weight percent tungsten components, calculated as $WO_3$, on a support of silica uniformly dispersed in a matrix of alumina. The support was composed of 25% by weight silica and 75% by weight alumina and had a surface area of 224 $m^2$/gm.

The foregoing catalysts were each utilized under the following conditions: 2000 psig, $H_2$ feed rate of 10,000 scf/bbl of feed, and 1.0 LHSV. Temperatures were varied between about 749° and 820° F., and the results of so varying the temperature with respect to pour point, sulfur content, and nitrogen content of the product is shown in the following Table VII:

TABLE VII

| Operating Temperature, °F. | Product Sulfur, Nitrogen, and Pour Point: Pour Point °F. A | Pour Point °F. B | Nitrogen, wppm A | Nitrogen, wppm B | Sulfur, wppm A | Sulfur, wppm B |
|---|---|---|---|---|---|---|
| 749 | — | 80 | — | 1230 | — | 107 |
| 760 | 75 | — | 165 | — | 46 | — |
| 780 | 75 | 80 | 55 | 84 | 46 | 30 |
| 800 | 75 | — | 9 | — | 23 | — |
| 810 | — | 55 | — | 5 | — | 18 |
| 820 | 70 | — | 4 | — | 22 | — |

The foregoing data clearly show the high denitrogenation and desulfurization activities of Catalysts A and B when used to treat shale oils. It is most highly preferred in the invention that these catalyst or any other hydrotreating catalyst employed prior to the simultaneous hydrotreating-hydrodewaxing step be used under conditions such that the nitrogen content of the liquid product recovered from the hydrotreating step is less than 500 wppm, and more preferably still, less than 450 wppm.

In less preferred embodiments of the invention, wherein waxy, organonitrogen-containing feedstocks are treated by the two-step procedure described for shale oils, it may be desirable to remove ammonia from the effluent of the hydrotreating stage so that the feed to the simultaneous hydrodewaxing-hydrotreating stage contains essentially no ammonia. This may be accomplished by any convenient means, such as absorption in a caustic solution. This procedure has the advantage of removing a known hydrocracking deactivating component, i.e., ammonia, from the material in contact with the catalyst of the second stage. In this embodiment of the invention, one obtains much reduced pour points under otherwise similar operating conditions. But such a method in many instances is either unnecessary, the pour point being reduced sufficiently even in the presence of ammonia, or too costly, requiring additional capital expense for a scrubber of the like.

Although the invention has been described in conjunction with examples thereof, many modifications, variations, and alternatives of the invention as described will be apparent to those skilled in the art. Accordingly, it is intended to embrace within the invention all such variations, modifications, and alternatives as fall within the spirit and scope of the appended claims.

We claim:

1. A process for treating a waxy shale oil feedstock containing organonitrogen compounds and components boiling above about 670° F., which process comprises contacting said feedstock with a catalyst comprising a Group VIB metal component and a Group VIII metal component on a support comprising an intimate admixture of a porous refractory oxide and a crystalline zeolite having a crystal density not less than 1.6 grams per cubic centimeter, a silica-to-alumina ratio of at least 12, and a constraint index within the range of 1 to 12 at an elevated pressure and an elevated temperature less than about 800° F. and in the presence of hydrogen so as to convert less than about 25 percent of said components boiling above about 670° F. to components boiling below 670° F. and yield a product of reduced pour point and reduced organonitrogen content in comparison to said feedstock, with the reduction in organonitrogen content being over 75 percent.

2. A process as defined in claim 1 wherein said waxy shale oil feedstock contains constituents boiling above about 750° F. but less than about 50% of said constituents, by volume, are converted during said contacting to constituents boiling below 750° F.

3. A process as defined in claim 1 wherein said feedstock contains a Jet A turbine fuel fraction boiling between 300° and 520° F., which fraction has a freeze point above −40° F., but the Jet A turbine fuel fraction of said product, as a result of said contacting, has a freeze point below −40° F.

4. A process as defined in claim 1 wherein said feedstock contains a JP-4 turbine fuel fraction consisting of constituents boiling at temperatures less than 470° F., which JP-4 fraction has a freeze point above −72° F., but the JP-4 fraction of said product, as a result of said contacting, has a freeze point below −72° F.

5. A process as defined in claim 1 wherein said feedstock contains a diesel fraction boiling between 300° and 670° F., which diesel fraction has a pour point greater than +5° F., but the diesel fuel fraction boiling between 300° and 670° F. of said product, as a result of said contacting, has a pour point no greater than +5° F.

6. A process as defined in claim 1 wherein said feedstock also contains organosulfur components and, as a result of said contacting, said product contains a reduced organosulfur content in comparison to said feedstock.

7. A process as defined in claim 1, 2, 3, 4, 5, or 6 wherein said zeolite is selected from the group consisting of ZSM-5, ZSM-11, ZSM-12, ZSM-23, ZSM-35, and ZSM-38, and said refractory oxide contains alumina.

8. A process as defined in claim 1 wherein said contacting is at a temperature less than about 750° F.

9. A process as defined in claim 1 wherein said feedstock contains organonitrogen components in a concentration above about 1.5 wt.%, calculated as nitrogen, and said product contains organonitrogen components in a concentration below about 400 wppm.

10. A process as defined in claim 1 wherein said feedstock contains organonitrogen components in a concentration above about 1.4 wt.%, calculated as nitrogen, and organosulfur components in a concentration above about 0.2 wt.%, calculated as sulfur, and said product contains less than 400 wppm organonitrogen components and less than 25 wppm organosulfur components.

11. A process as defined in claim 1, 2, 9, or 10 wherein said feedstock has a pour point above about 50° F. and said pour point of the product is below 30° F.

12. A process as defined in claim 1, 2, or 10 wherein said feedstock has a pour point above about 70° F. and said pour point of said product is below 30° F.

13. A process as defined in claim 1, 2, 3, 4, 5, or 10 wherein said catalyst comprises nickel components as the Group VIII metal component and tungsten components as the Group VIP metal component, said catalyst containing more nickel than could be contained in the ion exchange sites of said zeolite, with said zeolite being in an acidic form.

14. A process as defined in claim 12 wherein said catalyst comprises nickel components as the Group VIII metal component and tungsten components as the Group VIB metal component, said catalyst containing more nickel than could be contained in the ion exchange sites of said zeolite, with said zeolite being in an acidic form.

15. A process as defined in claim 1 wherein said catalyst contains more of said Group VIII metal than could be contained in the ion exchange sites of said zeolite.

16. A process as defined in claim 15 wherein said catalyst contains at least 0.5 wt.% of Group VIII metal components, calculated as the monoxides, and at least 5 wt.% of Group VIB metal components, calculated as the trioxides.

17. A process for upgrading a waxy hydrocarbon feedstock derived from shale oil, said feedstock containing organonitrogen components, organosulfur components, and components boiling above about 670° F. and having a pour point above about 50° F., which process comprises:

(1) hydrotreating said feedstock by contact with a sulfided catalyst comprising a Group VIII metal component and a Group VIB metal component on a porous refractory oxide support in the presence of hydrogen and under conditions reducing the organonitrogen content and the organosulfur content of the shale oil feedstock while increasing the pour point thereof;

(2) contacting at an elevated temperature below about 800° F. the entire effluent from step (1) with a catalyst comprising a Group VIII metal component and a Group VIB metal component on a support comprising a porous refractory oxide in intimate admixture with a crystalline aluminosilicate zeolite having a crystal density not less than 1.6 grams per cubic centimeter, a silica-to-alumina ratio of at least 12, and a constraint index within the range of 1 to 12 in the presence of hydrogen and under conditions, wherein less than about 25 percent by volume of said components boiling above about 670° F. are converted to components boiling below about 670° F., further reducing the organosulfur content and further reducing the organonitrogen content by over 75 percent while decreasing the pour point below 30° F.; and (3) recovering a product hydrocarbon having a pour point below 30° F. and containing a decreased concentration of organonitrogen and organosulfur components in comparison to said feedstock.

18. A process as defined in claim 17 wherein said feedstock contains more than about 0.2 wt.% organosulfur compounds, calculated as sulfur, and more than about 1.5 wt.% organonitrogen compounds, calculated as nitrogen, and said product hydrocarbon in step (3) contains less than 400 wppm organonitrogen compounds and less than 25 wppm organosulfur compounds.

19. A process as defined in claim 17 wherein said catalyst in step (2) comprises ZSM-5 in an acidic form.

20. A process as defined in claim 19 wherein said catalyst in step (2) is sulfided and contains nickel components as the Group VIII metal component and tungsten components as the Group VIB metal component, said nickel being present in an amount in the catalyst above that required to fully occupy all the ion exchange sites of the zeolite.

21. A process as defined in claim 20 wherein the organonitrogen content of said product hydrocarbon is less than 200 wppm while that of said feedstock is above about 1.5 weight percent.

22. A process as defined in claim 17, 18, 19, 20, or 21 wherein the contacting in step (2) is controlled to further reduce the organosulfur content by at least 50 percent.

23. A process as defined in claim 21 wherein said feedstock is a deashed and dearsenated shale oil.

24. A process as defined in claim 23 wherein the pour point of the liquid phase of the entire effluent in step (2) is above 70° F.

25. A process as defined in claim 20 wherein said entire effluent contains constituents boiling above about 750° F. but less than about 50% of said constituents, by volume, are converted during said contacting in step (2) to constituents boiling below 750° F.

26. A process as defined in claim 20 wherein said feedstock contains a Jet A turbine fuel fraction boiling between 300° and 520° F., which fraction has a freeze point above −40° F., but the Jet A turbine fuel fraction of said product hydrocarbon has a freeze point below −40° F.

27. A process as defined in claim 20 wherein said feedstock contains a JP-4 turbine fuel fraction consisting of constituents boiling at temperatures less than 470° F., which JP-4 fraction has a freeze point above −72° F., but the JP-4 fraction of said product hydrocarbon has a freeze point below −72° F.

28. A process as defined in claim 20 wherein said feedstock contains a diesel fraction boiling between 300° and 670° F., which diesel fraction has a pour point greater than +5° F., but the diesel fuel fraction boiling between 300° and 670° F. of said product hydrocarbon has a pour point no greater than +5° F.

29. A process for upgrading a waxy hydrocarbon feedstock derived from shale oil, said feedstock containing organonitrogen components, organosulfur components, and components boiling above about 670° F. and having a relatively high pour point, which process comprises:

(1) hydrotreating said feedstock by contact with a sulfided catalyst comprising a Group VIII metal component and a Group VIB metal component on a porous refractory oxide support in the presence of hydrogen and under conditions reducing the organonitrogen content and the organosulfur content of the shale oil feedstock while increasing the pour point thereof;

(2) contacting at an elevated temperature below about 800° F. the entire effluent from step (1) with a catalyst comprising a Group VIII metal component and a Group VIB metal component on a support comprising a porous refractory oxide in intimate admixture with a crystalline aluminosilicate zeolite having a crystal density not less than 1.6 grams per cubic centimeter, a silica-to-alumina ratio of at least 12, and a constraint index within the range of 1 to 12 in the presence of hydrogen and under conditions, wherein less than about 25 percent by volume of said components boiling above about 670° F. are converted to components boiling below about 670° F., further reducing the organosulfur content and further reducing the organonitrogen content by over 75 percent while decreasing the pour point below that of said feedstock introduced into step (1); and (3) recovering a product hydrocarbon having a reduced pour point and containing a decreased concentration of organonitrogen and organosulfur components in comparison to said feedstock.

30. A process as defined in claim 29 wherein said entire effluent contains constituents boiling above about 750° F. but less than about 50% of said constituents, by volume, are converted during said contacting in step (2) to constituents boiling below 750° F.

31. A process for treating a waxy shale oil feedstock containing components boiling above about 670° F. and organonitrogen components in a concentration of at least 400 wppm, which process comprises contacting said feedstock with a catalyst comprising a Group VIB metal component and a Group VIII metal component on a support comprising an intimate admixture of a porous refractory oxide and a crystalline zeolite having a crystal density not less than 1.6 grams per cubic centimeter, a silica-to-alumina ratio of at least 12, and a constraint index within the range of 1 to 12 at an elevated pressure and an elevated temperature less than about 800° F. and in the presence of hydrogen so as to convert less than about 25 percent by volume of said components boiling above about 670° F. to components boiling below about 670° F. and yield a product of reduced pour point in comparison to said feedstock and of organonitrogen concentration less than 200 wppm.

32. A process as defined in claim 31 wherein the organonitrogen concentration of said feedstock is at least 450 wppm.

33. A process as defined in claim 32 wherein the organonitrogen concentration of said feedstock is less than 1000 wppm.

34. A process as defined in claim 31 wherein the organonitrogen concentration of said feedstock is less than 1000 wppm.

35. A process as defined in claim 31 wherein said waxy shale oil feedstock contains constituents boiling above about 750° F. but less than 50% of said constituents, by volume, are converted during said contacting to constituents boiling below 750° F.

36. A process as defined in claim 31, 33, or 35 wherein said zeolite is ZSM-5.

37. A process as defined in claim 31 wherein said contacting is at a temperature less than about 750° F.

38. A process as defined in claim 31 or 35 wherein said feedstock has a pour point above about 50° F. and said pour point of the product is below 30° F.

39. A process as defined in claim 32 or 35 wherein said feedstock has a pour point above about 70° F. and said pour point of said product is below 30° F. and said zeolite is ZSM-5.

40. A process as defined in claim 31, 33, or 34 wherein said catalyst comprises nickel components as the Group VIII metal component and tungsten components as the Group VIB metal component, said catalyst containing more nickel than could be contained in the ion exchange sites of said zeolite, with said zeolite being ZSM-5 in an acidic form.

41. A process as defined in claim 1, 31, 35, or 37 wherein said feedstock also contains organosulfur components which, during said contacting, are reduced by over 50 percent.

42. A process as defined in claim 41 wherein said feedstock has a pour point above about 50° F. and said pour point of said product is below 30° F.

43. A process as defined in claim 2, 8, 9, 32, or 34 wherein said feedstock also contains organosulfur components which, during said contacting, are reduced by over 50 percent.

44. A process as defined in claim 43 wherein said catalyst comprises nickel components as the Group VIII metal component and tungsten components as the Group VIB metal component, said catalyst containing more nickel than could be contained in the ion exchange sites of said zeolite, with said zeolite being ZSM-5 in an acidic form, and wherein said pour point of said feedstock is above 70° F. and said pour point of said product is below 30° F.

45. A process for treating a waxy shale oil feedstock containing components boiling above about 670° F. and organonitrogen compounds, which process comprises contacting said feedstock with a catalyst comprising a Group VIB metal component and a Group VIII metal component on a support comprising an intimate admixture of a porous refractory oxide and 2 to 90 percent by weight of a crystalline aluminosilicate zeolite which readily adsorbs n-hexane but not 2,2-dimethylbutane at an elevated pressure and an elevated temperature less than about 800° F. and in the presence of hydrogen so as to convert less than about 25 percent by volume of said components boiling above about 670° F. to components boiling below about 670° F. and yield a product of reduced pour point and reduced organonitrogen content in comparison to said feedstock, with the reduction in organonitrogen content being over 75 percent.

46. A process as defined in claim 45 wherein said waxy shale oil feedstock contains constituents boiling above about 750° F. but less than about 50% of said constituents, by volume, are converted during said contacting to constituents boiling below 750° F.

47. A process for treating a waxy shale oil feedstock containing components boiling above about 670° F. and organonitrogen components in a concentration of at least 400 wppm, which process comprises contacting said feedstock with a catalyst comprising a Group VIB metal component and a Group VIII metal component on a support comprising an intimate admixture of a porous refractory oxide and 2 to 90 percent by weight of a crystalline aluminosilicate zeolite which readily adsorbs benzene but not metaxylene at an elevated pressure and an elevated temperature less than about 800° F. and in the presence of hydrogen so as to convert less than about 25 percent by volume of said components boiling above about 670° F. to components boiling below about 670° F., and yield a product of reduced pour point in comparison to said feedstock and of organonitrogen concentration less than 200 wppm.

48. A process as defined in claim 47 wherein said waxy shale oil feedstock contains constituents boiling above about 750° F. but less than about 50% of said constituents, by volume, are converted during said contacting to constituents boiling below 750° F.

49. A process as defined in claim 45, 46, 47, or 48 wherein said feedstock contains organosulfur components which, during said contacting, are reduced by over 50 percent.

50. A process as defined in claim 49 wherein said feedstock has a pour point above about 50° F. and said pour point of said product is below 30° F.

51. A process as defined in claim 45, 46, 47, or 48 wherein said feedstock has a pour point above 70° F. and said pour point of said product is below 30° F.

52. A process for treating a waxy shale oil feedstock containing components boiling above about 670° F. and organonitrogen compounds, which process comprises contacting said feedstock with a catalyst comprising a Group VIB metal component and a Group VIII metal component on a support comprising an intimate admixture of a porous refractory oxide and a ZSM-5 zeolite at an elevated pressure and an elevated temperature less than about 800° F. and in the presence of hydrogen so as to convert less than about 25 percent by volume of said components boiling above about 670° F. to components boiling below about 670° F., and yield a product of reduced pour point and reduced organonitrogen content in comparison to said feedstock, with the reduction in organonitrogen content being over 75 percent.

53. A process as defined in claim 52 wherein said waxy shale oil feedstock contains constituents boiling above about 750° F. but less than about 50% of said constituents, by volume, are converted during said contacting to constituents boiling below 750° F.

54. A process as defined in claim 52 wherein said contacting is at a temperature less than about 750° F.

55. A process as defined in claim 19, 25, 29, 30, or 52 wherein said feedstock contains organonitrogen components in a concentration above about 1.5 wt.%, calculated as nitrogen, and said product contains organonitrogen components in a concentration below about 400 wppm.

56. A process as defined in claim 52 wherein said feedstock contains organonitrogen components in a concentration above about 1.4 wt.%, calculated as nitrogen, and organosulfur components in a concentration above about 0.2 wt.%, calculated as sulfur, and said product contains less than 400 wppm organonitrogen components and less than 25 wppm organosulfur components.

57. A process as defined in claim 52, 53, or 54 wherein said feedstock has a pour point above about 50° F. and said pour point of the product is below 30° F.

58. A process as defined in claim 52 or 56 wherein said feedstock has a pour point above about 70° F. and said pour point of said product is below 30° F.

59. A process as defined in claim 52 wherein said feedstock also contains organosulfur components and, as a result of said contacting, said product contains a reduced organosulfur content in comparison to said feedstock by over 50 percent.

60. A process as defined in claim 57 wherein said feedstock also contains organosulfur components and, as a result of said contacting, said product contains a reduced organosulfur content in comparison to said feedstock by over 50 percent.

61. A process for treating a waxy shale oil feedstock containing components boiling above about 670° F. and organonitrogen compounds, which process comprises contacting said feedstock with a catalyst comprising between about 5 and 40 weight percent of a Group VIB metal component, calculated as the metal trioxide, and between 0.5 and 15 weight percent of a Group VIII metal component, calculated as the metal monoxide, on a support comprising an intimate admixture of a porous refractory oxide and a crystalline aluminosilicate zeolite having an effective pore diameter greater than 5 angstroms and a crystalline density of not less than 1.6 grams per cubic centimeter at an elevated pressure and an elevated temperature less than about 800° F. and in the presence of hydrogen so as to convert less than 25 percent by volume of the components boiling above about 670° F. into components boiling below about 670° F. and yield a product of reduced pour point and organonitrogen content in comparison to said feedstock, with the reduction in organonitrogen content being over 75 percent.

62. A process as defined in claim 61 wherein said waxy shale oil feedstock contains constituents boiling above about 750° F. but less than about 50 percent of said constituents, by volume, are converted during said contacting to constituents boiling below 750° F.

63. A process as defined in claim 62 wherein said feedstock has a pour point above about 50° F. and said pour point of the product is below 30° F.

64. A process as defined in claim 61, 62, or 63 wherein said feedstock also contains organosulfur components which, during said contacting, are reduced by over 50 percent.

65. A process as defined in claim 64 wherein said Group VIB metal component comprises tungsten components and said Group VIII metal component comprises nickel components.

66. A process as defined in claim 61 wherein said Group VIB metal component is selected from the group consisting of tungsten and molybdenum components and said Group VIII metal component is selected from the group consisting of nickel and cobalt components.

67. A process as defined in claim 25, 29, or 30 wherein said contacting in step (2) is at a temperature below 750° F., said feedstock contains organonitrogen components in a concentration above about 1.4 weight percent, calculated as nitrogen, and said product hydrocarbon contains less than 400 wppm organonitrogen components.

* * * * *

UNITED STATES PATENT AND TRADEMARK OFFICE

CERTIFICATE OF CORRECTION

PATENT NO. : 4,600,497

DATED : July 15, 1986

INVENTOR(S) : John W. Ward et al.

It is certified that error appears in the above-identified patent and that said Letters Patent is hereby corrected as shown below:

Column 13, line 55, "VIP" should read -- VIB --.

Signed and Sealed this

Thirty-first Day of March, 1987

*Attest:*

DONALD J. QUIGG

*Attesting Officer*

*Commissioner of Patents and Trademarks*